US008109564B2

(12) United States Patent
Lin et al.

(10) Patent No.: US 8,109,564 B2
(45) Date of Patent: Feb. 7, 2012

(54) SEAT SELF-LIFTING DEVICE FOR PORTABLE CHAIR

(76) Inventors: Mei Chuen Lin, Taoyuan (TW); Tzu Mei Wang, Taoyuan (TW)

( * ) Notice: Subject to any disclaimer, the term of this patent is extended or adjusted under 35 U.S.C. 154(b) by 144 days.

(21) Appl. No.: 12/699,213

(22) Filed: Feb. 3, 2010

(65) Prior Publication Data

US 2011/0187170 A1 Aug. 4, 2011

(51) Int. Cl.
*A47C 4/00* (2006.01)
*A47C 1/121* (2006.01)

(52) U.S. Cl. ..... 297/23; 297/332

(58) Field of Classification Search ..... 297/23, 297/332

See application file for complete search history.

(56) References Cited

U.S. PATENT DOCUMENTS 1,165,654 A * 12/1915 Eisner ..... 297/332 X
2,164,116 A * 6/1939 Lincoln ..... 297/332
2,268,914 A * 1/1942 Vandervoort ..... 297/332
2,620,858 A * 12/1952 Hoven et al. ..... 297/332 X
3,287,060 A * 11/1966 Thompson ..... 297/332
3,690,726 A * 9/1972 Van Ryn ..... 297/332
3,982,785 A * 9/1976 Ambasz ..... 297/337 X
5,288,128 A * 2/1994 Smith et al. ..... 297/332
5,601,335 A * 2/1997 Woods et al. ..... 297/332 X
5,803,546 A * 9/1998 Yamazaki ..... 297/332 X
5,899,531 A * 5/1999 Koehler ..... 297/332 X
6,481,789 B1 * 11/2002 Ambasz ..... 297/332 X
6,523,900 B1 * 2/2003 Conner et al. ..... 297/332
6,652,030 B2 * 11/2003 Conner et al. ..... 297/332 X
6,742,839 B2 * 6/2004 Piretti ..... 297/239
7,147,286 B2 * 12/2006 Cesaroni et al. ..... 297/331 X
7,303,235 B1 * 12/2007 Fongers ..... 297/332 X
7,367,627 B2 * 5/2008 Figueras Mitjans ..... 297/332 X
7,950,507 B2 * 5/2011 Figueras Mitjans ..... 297/332 X
2003/0189368 A1 * 10/2003 Fewchuk ..... 297/332

* cited by examiner

*Primary Examiner* — Rodney B White
(74) *Attorney, Agent, or Firm* — Rabin & Berdo, P.C.

(57) ABSTRACT

A seat self-lifting device for a portable chair is mounted between a seat frame and a front leg of the portable chair. The seat self-lifting device includes a rotary axle, a spiral spring and a fixing rod. The rotary axle passes through the front leg and connects with a connecting plate mounted on the seat frame. The fixing rod is perpendicularly disposed on the front leg. The spiral spring has a first end connected with the rotary axle and a second end wrapped around the fixing rod. When the seat is deployed, the rotary axle is rotated along a direction and the spiral spring is deformed to accumulate a resilient force. When the user leaves the seat, the resilient force of the spiral spring rotates the rotary axle along a reverse direction for flipping the seat to a collapsed state.

5 Claims, 6 Drawing Sheets

SEAT SELF-LIFTING DEVICE FOR PORTABLE CHAIR

BACKGROUND OF THE INVENTION

1. Field of the Invention

The present invention relates generally to a seat lifting device, and more particularly to a seat self-lifting device for a portable chair.

2. The Prior Arts

A conventional collapsible and portable chair usually uses two pivotal structures to pivotally connect the seat to an inner side of the front leg, such that the seat can flip upward. In particular, the seat can be managed from a horizontal deployed position to a vertical collapsed position by manually flipping the seat. Because such operation is cumbersome, certain portable chairs include a seat collapsing mechanism. The conventional seat collapsing mechanism usually includes a tension spring whose one end is connected with a bottom of a seat frame and another end of the spring is connected with the front leg. When the seat is in a horizontal deployed position, the spring is extended. When the pressing force to deploy the seat is released, the extended spring is released to flip the seat to the vertical collapsed position. However, using the tension spring has the following drawbacks. (1) Some of the portable chairs are provided with abutting elements to prevent the seat from over-flipping. The spring may flip the seat too fast, which causes the seat to impact against the abutting elements of the portable chair and therefore makes noise. (2) The seat collapsing mechanism is entirely exposed under the seat, which is likely to injure the user. (3) The tension spring is more likely to subject to elastic fatigue or being over-stretched, which results in malfunction of collapsing operation.

SUMMARY OF THE INVENTION

A primary objective of the present invention is to provide a seat self-lifting device for a portable chair that overcomes the aforementioned disadvantages of the conventional designs. The seat self-lifting device can automatically lift a seat after the user stands up without folding the portable chair. The seat is lifted in a gentler manner, without making annoying noise. Moreover, the seat self-lifting device includes a cap that covers the entire seat self-lifting device and prevents the user from injuries. In addition, the seat self-lifting device uses a spiral spring, which is more rigid and less subject to elastic fatigue, preventing the conventional drawbacks.

To accomplish the objectives mentioned above, a seat self-lifting device for a portable chair according to the present invention is disposed between the seat and the front leg. The seat self-lifting device comprises a rotary axle, a spiral spring and a fixing rod. The rotary axle passes through the front leg and connects with a connecting plate mounted on the seat frame. The fixing rod is perpendicularly mounted on the front leg. The spiral spring has a first end connected with the rotary axle, and a second end wrapped around the fixing rod. When the seat is deployed, the rotary axle is rotated along a direction and the second end of the rotary axle presses on a first point on the fixing rod, causing the spiral spring to deform and accumulate a resilient force. When the user leaves the seat, the resilient force is released and the rotary axle rotates along a reverse direction to flip the seat to a collapsed state.

Instead of using a tension spring as conventional design, the seat self-lifting device according to the present invention uses a spiral spring that can provide a gentler driving force and a longer service life. As a result, the seat self-lifting device is more reliable in operation.

Because the second end of the spiral spring is wrapped around the fixing rod, when the seat flips to cause the second end of the spiral spring to contact with a second point on the fixing rod for stopping rotation of the seat. Excessive rotation of the seat causing its collision against abutting portions on the portable chair can be thereby prevented, eliminating annoying noise.

Furthermore, the seat self-lifting device may further include a cap that is fixed on the fixing rod by a fastener assembly. The cap can cover the entire seat self-lifting device, preventing accidental injury by direct contact with the seat self-lifting device.

Compared to the conventional designs, the seat self-lifting device of the present invention operates in a gentler manner, does not produce annoying noise, is safer and has a longer service life. In addition to the collapsible and portable chair, the seat self-lifting device according to the present invention may also be used in other types of chairs.

BRIEF DESCRIPTION OF THE DRAWINGS

The present invention will be apparent to those skilled in the art by reading the following detailed description of preferred embodiments thereof, with reference to the attached drawings, in which.

DETAILED DESCRIPTION OF THE PREFERRED EMBODIMENTS

Figure 1:
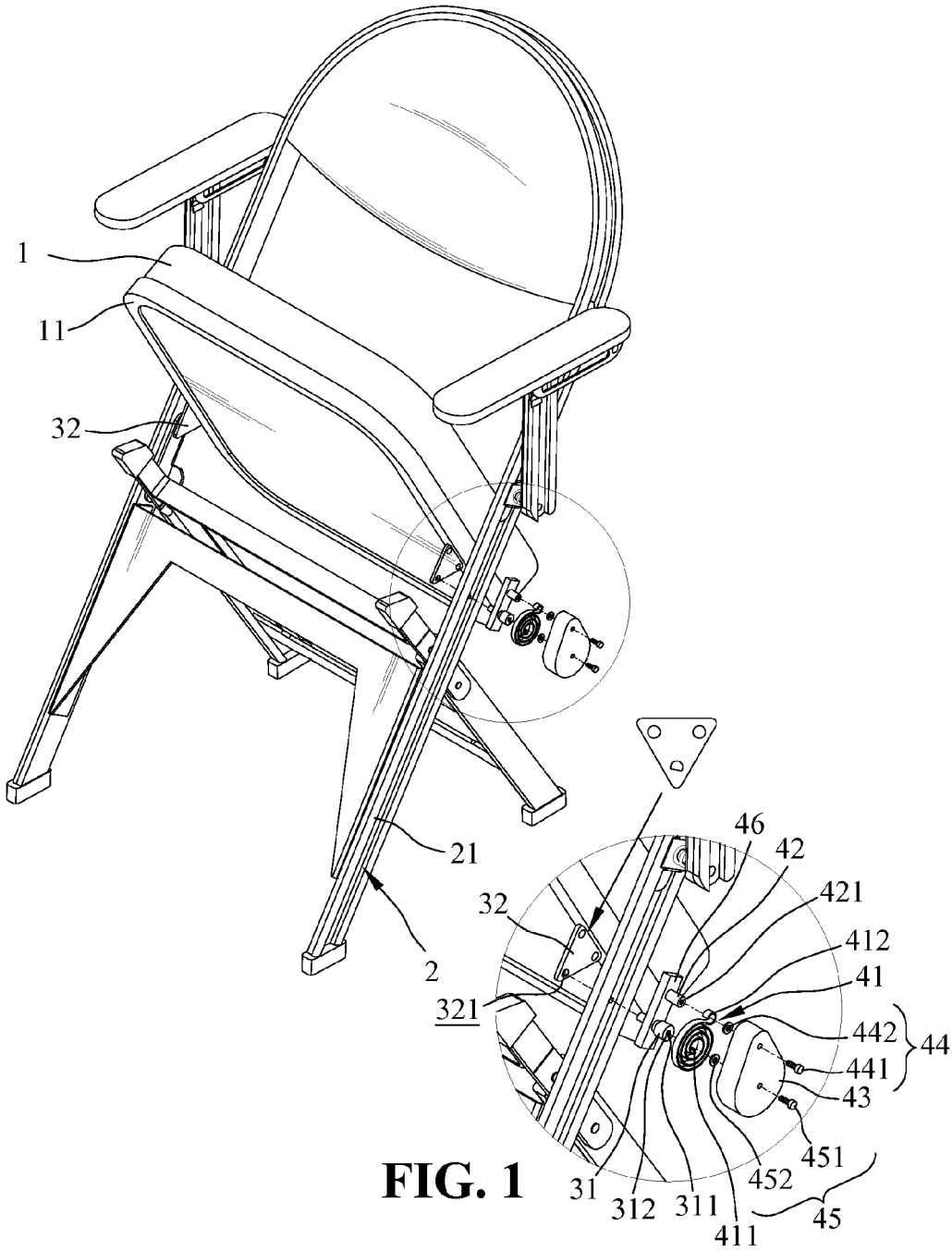
FIG. 1 is an exploded view illustrating a seat self-lifting device for a portable chair according to an embodiment of the present invention.
Figure 1A:
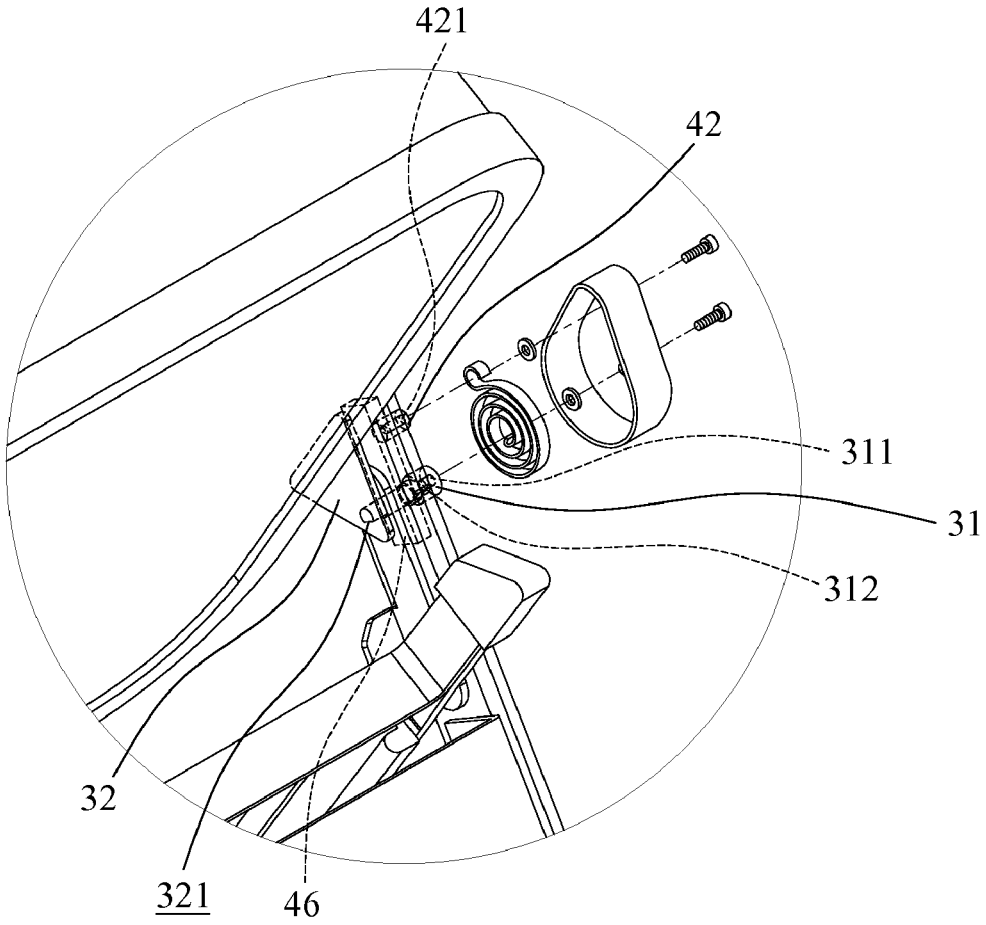
FIG. 1A is an exploded view of the seat self-lifting device of FIG. 1 in another viewing angle.
Figure 2:
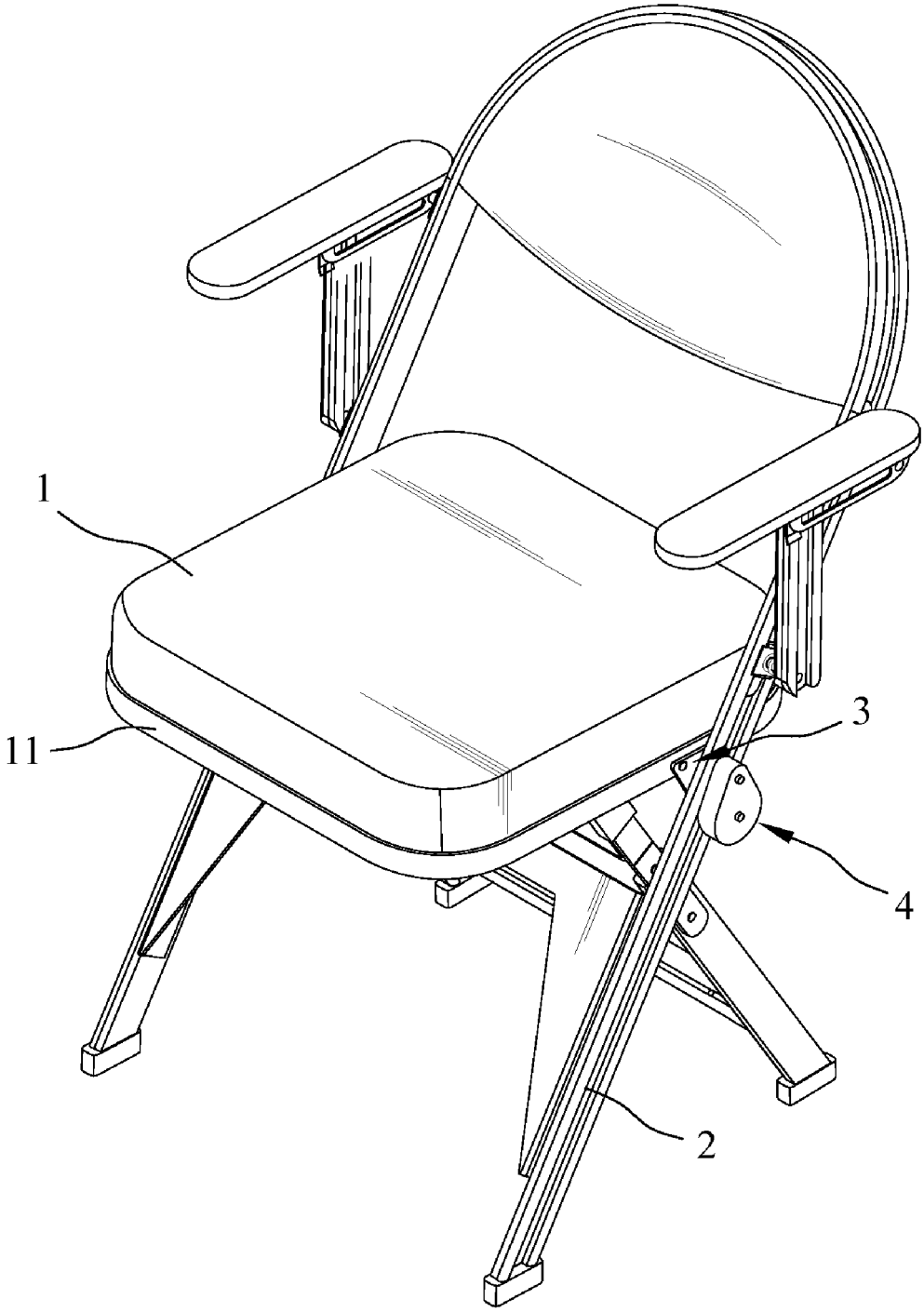
FIG. 2 is a perspective view showing the seat self-lifting device mounted on the portable chair according to the present invention.

Referring to FIGS. 1, 1A and 2, a seat self-lifting device for a portable chair according to an embodiment of the present invention include a pivotal structure 3 and a lifting device 4. The pivotal structure 3 is connected between a seat frame 11 and a front leg 2 of the portable chair. The pivotal structure 3 includes a connecting plate 32 connected with the seat frame 11, and a rotary axle 31. The rotary axle 31 has two portions. A first portion of the rotary axle 31 is a semi-circular cylinder and a second portion of the rotary axle 31 is a circular cylinder. The connecting plate 32 has a fixing hole 321 having a semi-circular shape corresponding to the first portion of the rotary axle 31. The first portion of the rotary axle 31 passes through the front leg 2 and the fixing hole 321 of the connecting plate 32. The second portion of the rotary axle 31 is exposed from a surface of the front leg 2. The connecting plate 32 can thereby rotate along with the rotary axle 31, which prevents free rotation of the rotary axle 31 in the fixing hole 321 that may cause flipping of a seat 1. The first portion of the rotary axle 31 may have a non-circular cross section other than the semi-circular one, as long as it can prevent the free rotation of the rotary axle 31. The lifting device 4 is mounted on the surface of the front leg 2 by the rotary axle 31. The lifting device 4 can lift the seat 1 to a collapsed state when the user leaves the seat 1.

Figure 3:
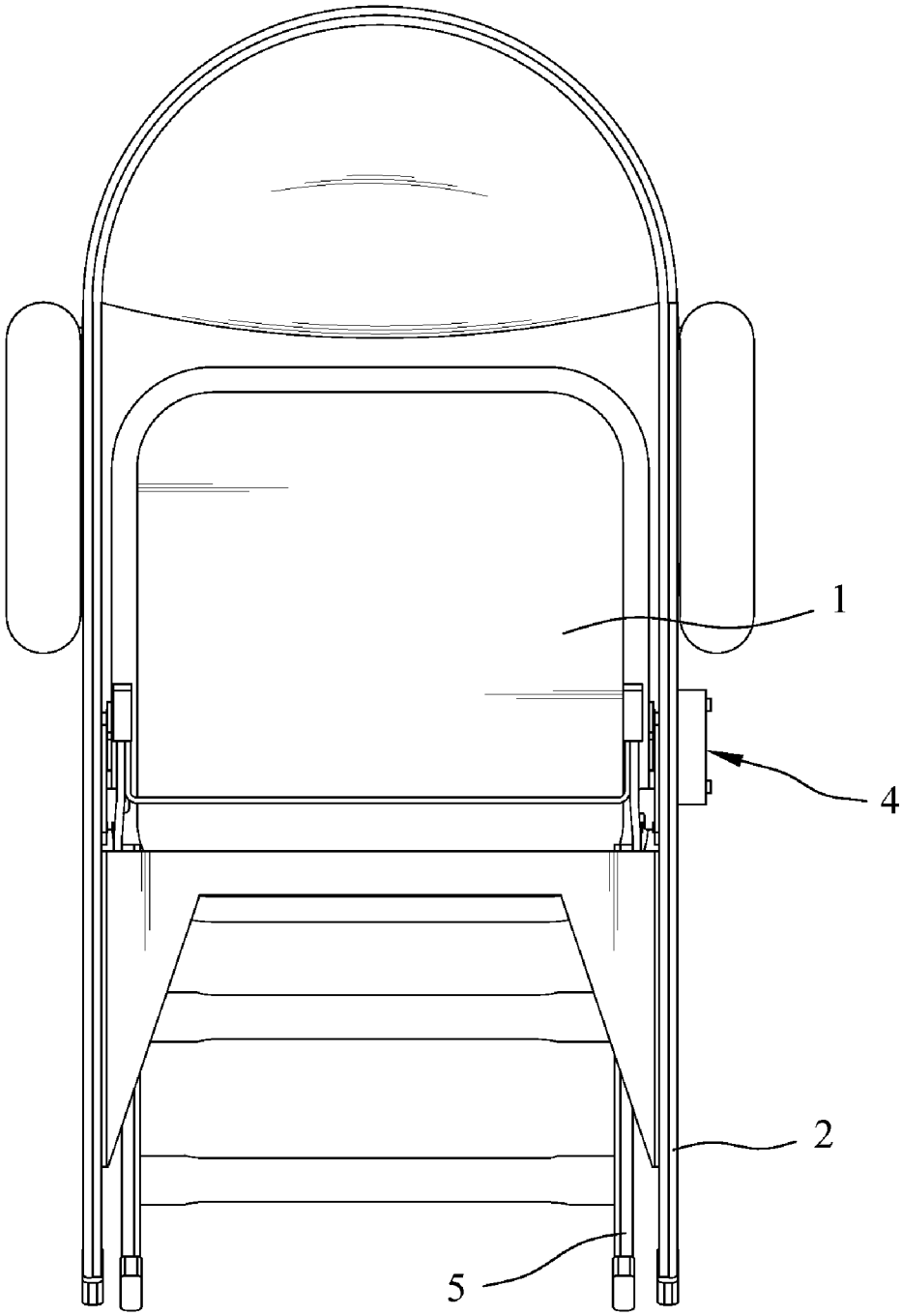
FIG. 3 is a front view of the portable chair in a folded state of FIG. 2.

The lifting device 4 may be assembled on a reinforcing piece 46. The reinforcing piece 46 have a width and a thickness corresponding to a width and a depth of a channel 21 of the front leg 2, and the reinforcing piece 46 is soldered in the channel 21, thereby reinforcing the strength of the lifting device 4. The lifting device 4 includes a fixing rod 42 and a spiral spring 41. The fixing rod 42 may be soldered perpendicular to the reinforcing piece 46. The first portion of the rotary axle 31 laterally passes through the front leg 2 and the reinforcing piece 46, and is assembled with the connecting plate 32. The second portion of the rotary axle 31 is exposed on an outer side of the reinforcing piece 46, and has a groove 311 that extends to a circumference surface thereof. A restoring force provided by the spiral spring 41 is gentler than that provided by a tension spring. Moreover, the spiral spring 41 allows a longer service life. The spiral spring 41 has two ends. A first end 411 of the spiral spring 41 is mounted on the rotary axle 31 and fixed in the groove 311. The second end 412 of the spiral spring 41 is bent to an annular shape to wrap around the fixing rod 42. The spiral spring 41 contacts with the surface of the reinforcing piece 46, so that the spiral spring 41 is indirectly mounted on the front leg 2. In order to prevent a user from being injured by the lifting device 4 exposed outside the front leg 2, a cap 43 is assembled to cover the fixing rod 42, the rotary axle 31 and the spiral spring 41. The cap 43 can have any suitable shape for covering the aforementioned elements. A first fastener assembly 44 including a bolt 441 and a nut 442 is used to attach the cap 43. The bolt 441 passes from the outside through the cap 43, and the nut 442 is tightly locked with the bolt 441 from the inner side of the cap 43 for preventing the bolt 441 from separating away from the cap 43. The bolt 441 further engages with a threaded hole 421 at an end of the fixing rod 42, thereby fixing the cap 43 on the fixing rod 42. The first fastener assembly may include any suitable elements other than bolt and nut, such as rivets, pins, and like detachable or non-detachable fastener elements. In order to prevent oscillation of a lower portion of the cap 43, the second portion of the rotary axle 31 may include a blind hole 312 for mounting a second fastener assembly 45. The second fastener assembly 45 includes a bolt 451 and a nut 452. The bolt 451 passes from the outside through the cap 43. The nut 452 is engaged with the bolt 451. Then, an end of the bolt 451 is inserted into the blind hole 312, which prevents the lower portion of the cap 43 from oscillation. However, a diameter of the bolt 451 is slightly smaller than that of the blind hole 312 and the bolt 451 is not in contact with the inner sidewall of the blind hole 312 so that the rotation of the rotary axle 31 is not affected. The second fastener assembly may include any suitable elements other than the bolt and the nut, such as rivets, pins, and like detachable or non-detachable fastener elements. FIG. 3 is a front view of the portable chair in a folded state. As the whole lifting device 4 is positioned outside the front leg 2, it does not interfere with the folding of the rear leg 5 to a stowed position at the inner side of the front leg 2 and the flipping of the seat 1.

Figure 4:
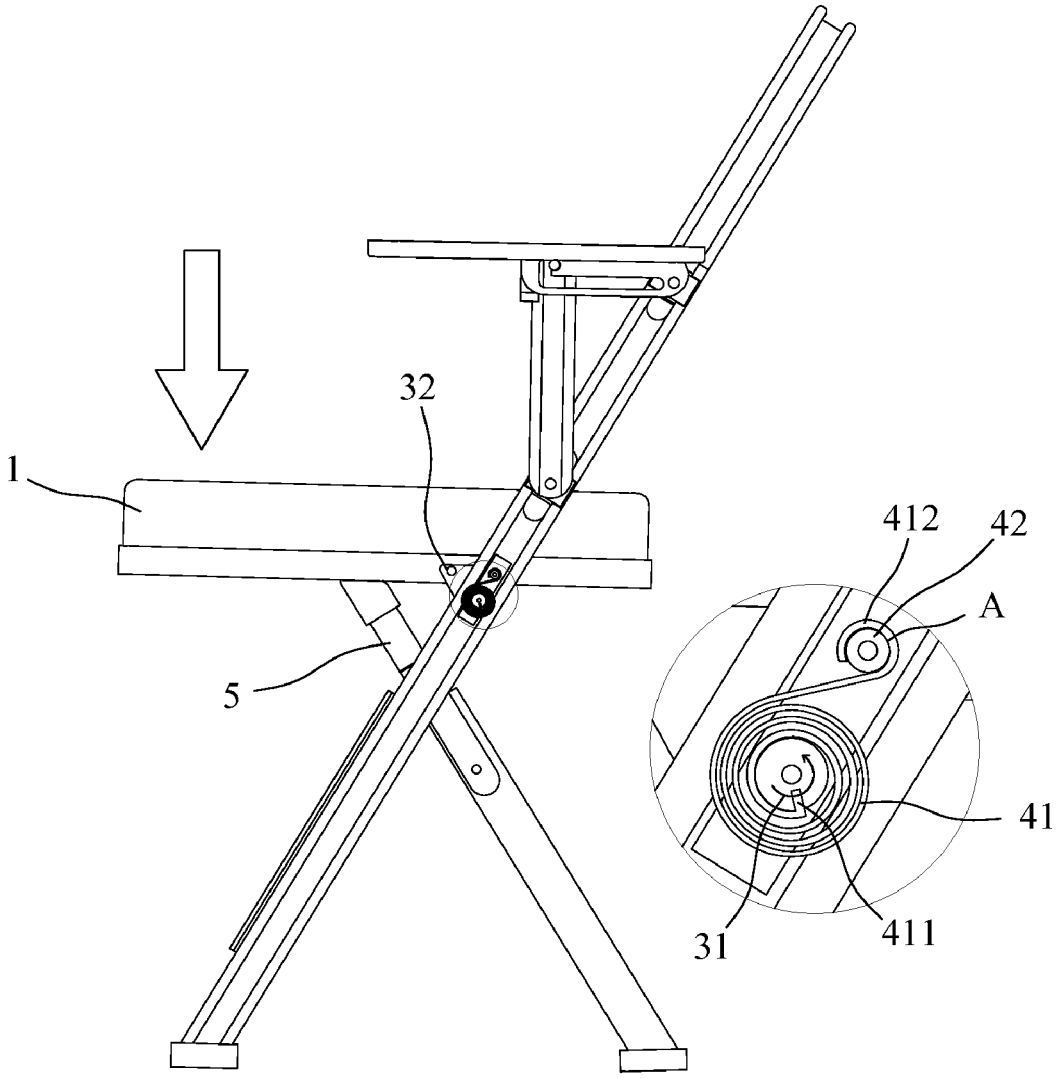
FIGS. 4-5 are schematic views illustrating operation of the seat self-lifting device according to the present invention.
Figure 5:
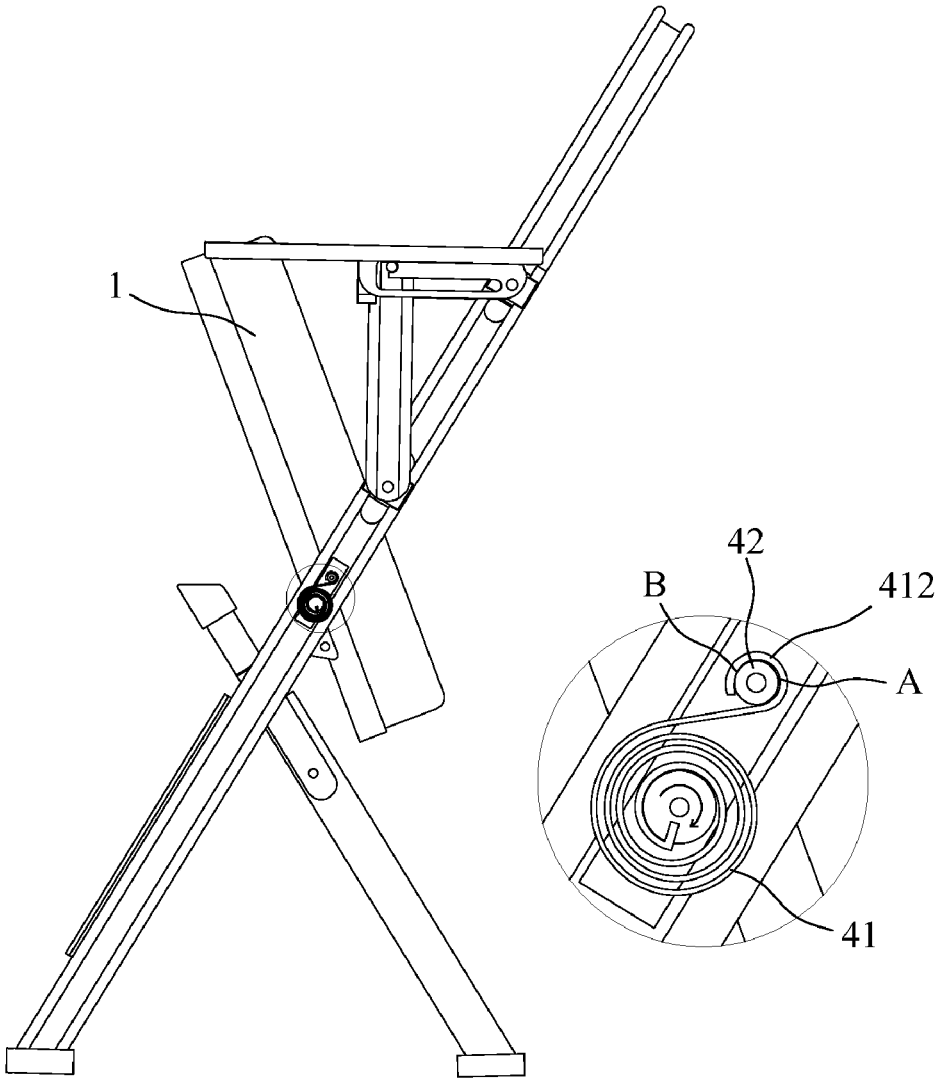

FIGS. 4 and 5 are schematic views illustrating the operation of the seat self-lifting device for the portable chair according to the present invention, wherein the cap 43 is omitted from drawings for clear illustration. Referring to FIG. 4, when a user sits on the seat 1, a downward pressure is applied on the seat 1, which causes the connecting plate 32 to rotate the rotary axle 31 counterclockwise. As a result, the first end 411 of the spiral spring 41 is pulled to tighten the spiral spring 41 by the rotation of the rotary axle 31. During the seat 1 being pressed down, the second end 412 of the spiral spring 41 presses against the point A of the fixing rod 42. As the downward pressure is continuously applied on the seat 1, the rotation of the rotary axle 31 causes the first end 411 of the spiral spring 41 to deform by radial contraction, until the seat 1 is entirely deployed to a horizontal position and rested on the rear leg 5. Referring to FIG. 5, when the user leaves the seat 1, the downward pressure on the seat 1 is removed. As a result, the elastic force of the spiral spring 41 causes the rotary axle 31 to rotate clockwise. The connecting plate 32 co-rotates with and rotary axle 31 and then the seat 1 flips upward until the second end 412 of the spiral spring 41 leaves the point A of the fixing rod 42 and abuts against the point B of the fixing rod 42. The spiral spring 41 thereby completes its restoring movement. The seat 1 is no longer subject to the force and does not continue to flip rearward. The position of the groove 311 and the torque applied by the spiral spring 41 is related to each other. In the illustrated embodiment, the position of the groove 311 can be set such that the spiral spring 41 can cause the seat 1 to flip to an angular position of about 70 degrees. In this manner, a space clearance can be created for allowing passage, while collision between the seat 1 and the seat abutting portion provided on the chair owing to excessive rotation or rotating speed of the seat 1 can be prevented. As a result, chair damages and annoying noise due to collision of the retracted seat 1 can be eliminated.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A seat self-lifting device for a portable chair, mounted between a seat frame and a front leg of the portable chair, the seat self-lifting device comprising:

a rotary axle having two opposite portions that are a first portion and a second portion, the first portion of the rotary axle being shaped in a non-circular cylinder, laterally passing through the front leg and connected with a connecting plate mounted on the seat frame to move therewith, the second portion of the rotary axle being shaped in a cylinder and exposed on the front leg;

a fixing rod perpendicularly mounted to the front leg and disposed proximate to the second portion of the rotary axle; and a spiral spring having a first end connected with the second portion of the rotary axle and a second end wrapped around the fixing rod, the spiral spring being rotatable and twistable along an axial direction of the rotary axle, wherein when a user sits on the seat, the rotary axle rotates with the connecting plate and twists the spiral spring to be deformed and accumulate a resilient force, and when the user leaves the seat, the resilient force is released and the release of the resilient force causes the rotary axle to rotate along a reverse direction to flip the seat to a collapsed state.

2. The seat self-lifting device as claim in claim 1, further comprising a cap fixed on the fixing rod by a first fastener assembly, wherein the cap is secured at a position covering the entire seat self-lifting device.

3. The seat self-lifting device as claimed in claim 2, further comprising a reinforcing piece disposed in a channel of the front leg, wherein the fixing rod is perpendicularly disposed on the reinforcing piece and the first portion of the rotary axle laterally passes through the reinforcing piece.

4. The seat self-lifting device as claimed in claim 1, further comprising a reinforcing piece disposed in a channel of the front leg, wherein the fixing rod is perpendicularly disposed on the reinforcing piece and the first portion of the rotary axle laterally passes through the reinforcing piece.

5. A seat self-lifting device for a portable chair, mounted between a seat frame and a front leg of the portable chair, the seat self-lifting device comprising:

a rotary axle having two opposite portions that are a first portion and a second portion, the first portion of the rotary axle being shaped in a non-circular cylinder, laterally passing through the front leg and connected with a connecting plate mounted on the seat frame to move therewith, the second portion of the rotary axle being shaped in a cylinder and exposed on the front leg;

a fixing rod perpendicularly mounted to the front leg and disposed proximate to the second portion of the rotary axle;

a spiral spring having a first end connected with the second portion of the rotary axle and a second end wrapped around the fixing rod; and a reinforcing piece disposed in a channel of the front leg, the fixing rod being perpendicularly disposed on the reinforcing piece and the first portion of the rotary axle laterally passing through the reinforcing piece, wherein when a user sits on the seat, the rotary axle rotates with the connecting plate and twists the spiral spring to be deformed and accumulate a resilient force; when the user leaves the seat, the resilient force is released and causes the rotary axle to rotate along a reverse direction to flip the seat to a collapsed state.

* * * * *